United States Patent [19]

Hickey et al.

[11] Patent Number: 5,064,126

[45] Date of Patent: Nov. 12, 1991

[54] SHREDDER

[75] Inventors: Colin J. Hickey, Haselbrook, Australia; Max R. Rajewski, Haywood, Calif.

[73] Assignee: Formark Pty. Limited, Australia

[21] Appl. No.: 455,401

[22] PCT Filed: May 6, 1988

[86] PCT No.: PCT/AU88/00135

§ 371 Date: Jan. 8, 1990

§ 102(e) Date: Jan. 8, 1990

[87] PCT Pub. No.: WO88/08750

PCT Pub. Date: Nov. 17, 1988

[30] Foreign Application Priority Data

May 6, 1987 [AU] Australia ..... PI 1756

[51] Int. Cl.[5] ..... B02C 13/04; B02C 13/286

[52] U.S. Cl. ..... 241/73; 241/101.7; 241/186.4; 241/190

[58] Field of Search ..... 241/190, 186.4, 101.7, 241/194, 186.2, 73, 101.2, 189 R

[56] References Cited

U.S. PATENT DOCUMENTS

| | | | |
|---|---|---|---|
| 2,650,745 | 9/1953 | Oberwortman . | |
| 2,691,338 | 10/1954 | Robbins | 241/101.2 X |
| 3,966,128 | 6/1976 | Anderson et al. | 241/186.2 X |
| 3,967,785 | 7/1976 | Grosch . | |
| 4,003,502 | 1/1977 | Barcell | 241/186.4 X |
| 4,106,706 | 8/1978 | Burrows | 241/186.4 X |
| 4,412,659 | 11/1983 | Crawford et al. . | |
| 4,448,361 | 5/1984 | Marcy | 241/186.4 X |

FOREIGN PATENT DOCUMENTS

| | | | |
|---|---|---|---|
| 220638 | 10/1957 | Australia . | |
| 2709582 | 9/1978 | Fed. Rep. of Germany . | |
| 998844 | 1/1952 | France . | |
| 251305 | 8/1948 | Switzerland . | |
| 747452 | 7/1980 | U.S.S.R. | 241/186.4 |

OTHER PUBLICATIONS

Derwent Abstract Accession No. J6798C/40, Class P12, SU, A, 716589 (Tselina Agric Mechn) 25 Feb. 1980 (25.02.80).

*Primary Examiner*—Mark Rosenbaum
*Attorney, Agent, or Firm*—Davis, Bujold & Streck

[57] ABSTRACT

A shredder for bulk waste paper comprising a rotatable hopper, a rotary hammer-mill (2) comprising a plurality of flails (24), a set of fingers (30) interdigitated with the flails in the floor of the hopper, a perforated screen (3) enclosing the lower portion of the hammer-mill, a reciprocating pusher (42) for compacting and discharging the shredded material and a drive mechanism (15, 48) for driving the rotatable hopper, the hammer-mill and the pusher.

12 Claims, 3 Drawing Sheets

SHREDDER

TECHNICAL FIELD

The present invention relates to a shredder for shredding waste paper, cardboard, packaging materials and other sheet media such as microfilm and microfiche. The construction is particularly adapted for large scale bulk industrial use, and may be transported for on-site use.

PRIOR ART

Shredders for small scale use are already known and these generally comprise two sets of intermeshed counterrotating wheels, into the nip of which the sheet of paper to be shredded is fed. Such shredders are generally able to cope with a single sheet or at the most a small number of sheets of paper at one time. Moreover, such shredders often have problems in dealing with staples, paper clips, and other metal commonly associated with documents. Such a construction is quite unable to cope when there are large amounts (for example, tonnes) of waste material to be shredded.

A number of shredders are known from prior art patent specifications. U.S. Pat. No. 3 967 785 discloses an apparatus for defibrating cellulose having a rotatable hopper and a milling cutter. U.S. Pat. No. 2 650 745, 3 483 906 and 3 615 059 disclose similar apparatus for grinding agricultural feedstuff. U.S. Pat. No. 4 412 659 describes a mill for shredding waste material having an adjustable grate for progressively feeding the material to the shredding wheel. DE 27 90 582 discloses the use of a hammer-mill to shred paper.

OBJECTS

The object of the present invention is to provide a shredder which is capable of shredding waste material with high throughput and of handling a mixture of different such materials randomly fed into the shredder. The shredder is intended to be able to cope with a wide variety of office waste paper, documents and other recording media, particularly that of a confidential or secret classification. For such an application it may be desirable to have the shredder mounted on a truck or trailer to allow it to shred such materials on-site so that the customer can satisfy himself that the material has indeed been safely disposed of. The invention thus also seeks to provide a transportable construction, which in addition enables the shredded waste to be reasonably compacted to minimise the volume of shredded material which must be taken away again.

SUMMARY OF THE INVENTION

The present invention provides a shredder for shredding bulk waste paper cardboard, packaging material, microfilm, microfiche and other sheet material, which comprises

- a receiving hopper for receiving material to be shredded which is rotatably mounted for rotation about an upstanding axis, and having a stationary floor;
- a rotary hammer-mill disposed below the hopper floor and protruding into the hopper for shredding material in the hopper, the hammer-mill comprising a plurality of flails loosely mounted to the circumference of a body rotatably mounted about a generally transverse axis;
- a set of fingers interdigitated with the flails and mounted on the stationary hopper floor on the side of the hammer-mill where rotation of the mill tends to force material downwardly out of the hopper;
- a perforated screen partially enclosing the hammer-mill below the hopper floor and through which the shredded material passes when it has reached a chosen level of comminution;
- reciprocating bailer means disposed in a duct arranged to receive the shredded material from the screen and to compact the shredded material, before discharging it from the duct past a non-return flap hingedly mounted at an outlet from the duct; and drive means arranged to drive the rotatable hopper, rotary hammer-mill and reciprocating bailer.

It has been found preferable to use a rotating hopper, which is circular in plan-view. The hopper is located above the hammer-mill, and the hammer-mill is preferably eccentrically located so that rotation of the hopper feeds material progressively over the hammer-mill. Usually, the hopper includes a paddle extending across it to feed the material to be shredded over the hammer-mill. In one construction, both the paddle and the walls of the hopper rotate together and this is found to be particularly advantageous. Alternatively, only the paddle is rotated.

The hammer-mill is arranged so that its upper portion protrudes into the receiving hopper so that as the hopper brings material over the hammer-mill it shaves off only a predetermined amount, thereby preventing clogging and overloading of the mill.

It has also been found to be necessary to provide fingers in the base of the receiving hopper, and which are interdigitated with the flails on the hammer-mill. Thus there is included a first set of fingers on the side of the mill where the material to be shredded is passed away from the receiving hopper, since this presents the material to the flails in an appropriate manner and also prevents clogging of material between the hammer-mill and the screen. It has also been found advantageous to provide a deflector plate or second set of fingers on the other side of the hammer-mill to help prevent partially shredded material from being flung out of the hammer-mill into the hopper again. This causes the partially shredded material to be carried around with the hammer-mill through the hopper and back past the first set of fingers.

The rotary hammer-mill can be of conventional construction and preferably comprises four or six series of flails loosely mounted to longitudinally extending rods interconnected by spaced plates constituting the body of the mill. The spaced plates allow each flail to move a predetermined extent in a longitudinal direction and also to a certain extent in a circumferential direction. The flails are loosely mounted to the rotatable body of the hammer-mill to allow the flails to ride over any particularly hard material, so preventing their breakage, and allowing the shredder to handle a wide variety of materials. Rigidly mounted flails tend to break off easily. The hammer-mill is rotated at, for example 1,000 to 3,000 RPM, by any suitable rotary drive means, such as a hydraulic motor, an electric motor or an internal combustion engine.

The purpose of the perforated screen is to contain the partially shredded material around the hammer-mill until it becomes small enough to pass through the perforations in the screen and be discharged from the shredder. Usually, the screen will extend all around the hammer-mill except for the portion of the hammer-mill projecting into the receiving hopper. The size of the perforations in the screen can be varied according to the degree of shredding desired. Generally, the clearance of the screen from the hammer-mill will be greatest adjacent the receiving hopper and least on the opposite side to the hopper.

A discharge means is provided for removing the shredded material. It is particularly envisaged that the shredder of the present invention shall be mobile and mounted on a truck for on-site shredding of bulk material. Thus, it is desirable to use a discharge means which not only removes the shredded material from the outlet of the shredder but also compacts it into a storage bin provided on the truck. It has been found to be particularly advantageous to use a reciprocating pusher (in the manner of an agricultural bailer) to push out the shredded material. Surprisingly, it has been found that this also provides a considerable degree of compaction. The bailer generally comprises a duct in which the pusher reciprocates, and into which shredded material is fed. It has been found necessary to provide a flap on the outlet of the duct, so as to reduce the rush of air into the duct as the reciprocating pusher withdraws which otherwise blows the shredded material back towards the screen.

DESCRIPTION OF PREFERRED EMBODIMENT

An embodiment of the invention will now be described with reference to drawings wherein:

FIG. 1 i a schematic cross-sectional elevation of a shredder according to the invention;

Figure 1:
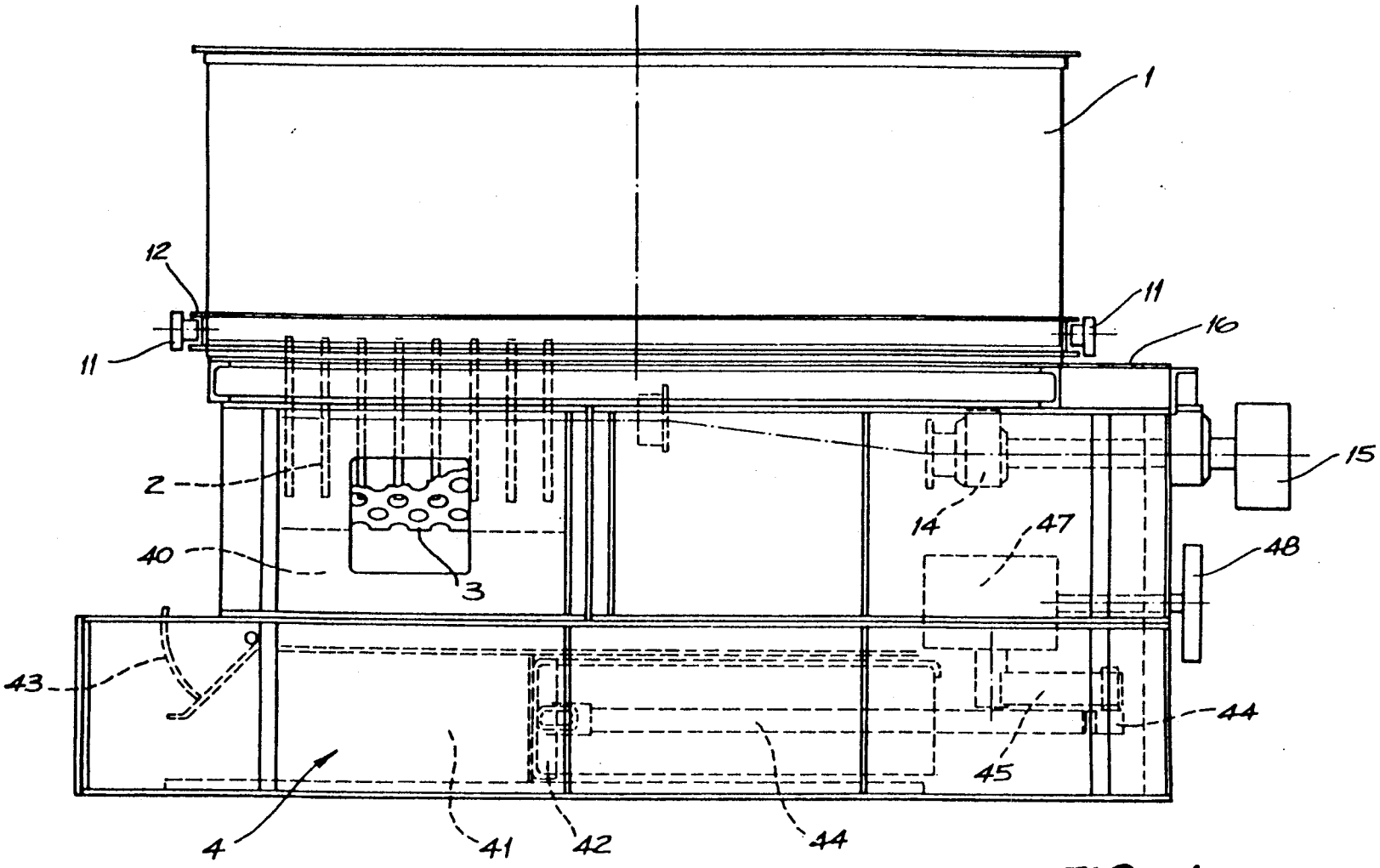
Figure 2:
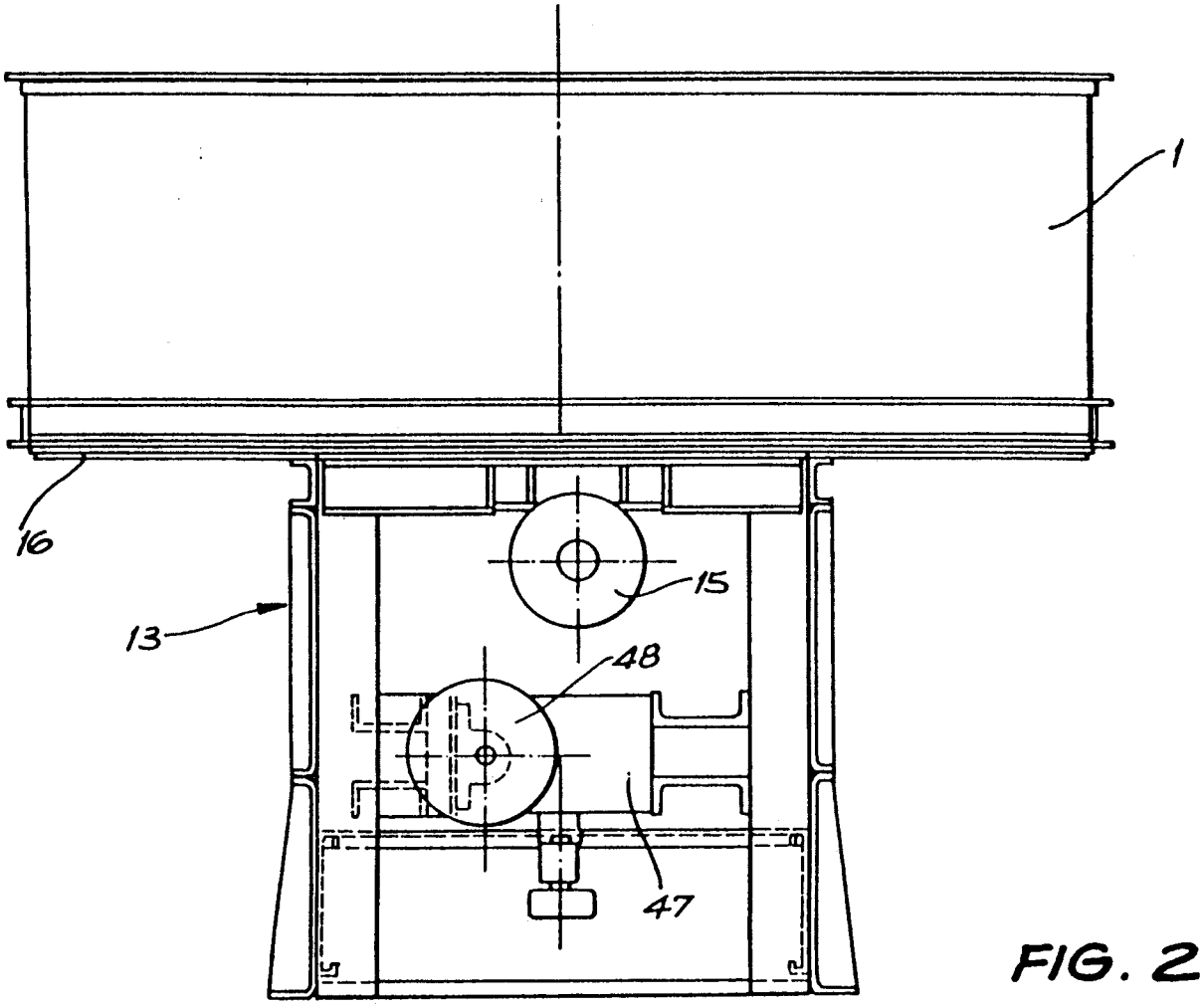
FIG. 2 is a side view.

The shredder comprises a receiving hopper 1 rotatably mounted above a stationary floor 16 on which is mounted a hammer-mill 2 surrounded by a screen 3, and discharge means 4.

The receiving hopper 1 is of circular cross-section and includes a paddle 10 which rotates therewith. The hopper 1 is rotatably mounted on wheels 11 which run along a track 12. The shredder has a body 13. The hopper is circumferentially driven by a tire 14 and associated drive means 15. Alternatively wheels 11 can be driven, or a separate drive wheel applied to track 12.

The hammer-mill 2 is rotatably mounted on a shaft 20 running in bearings 21 and 22 and driven by drive means 15. The rotatable body is comprised of six parallel rods, 23 held together by a series of spaced plates 25 mounted on the shaft 20. Flails 24 are loosely retained on the rods 23 between the spaced plates 25. The flails are formed of spring steel and are floating along and around the rods. The upper end of the hammer-mill 2 extends (for example, about 6 inches (about 15 cm)) upwards into the hopper.

The screen 3 surrounds the lower end of the hammer-mill which does not extend into the hopper. At its lower end, the screen is spaced approximately a quarter of an inch (about 6 mm) from the flails, and spaced about 2 inches (about 5 cm) from the flails at its upper ends. The size of the perforations may be varied depending on the nature of the material being shredded. For use on material consisting predominantly of paper oval perforations 15 to 20 mm wide and 40 mm long are preferred. For microfiche the perforations are preferably 5 mm wide and 10 mm long.

Figure 3:
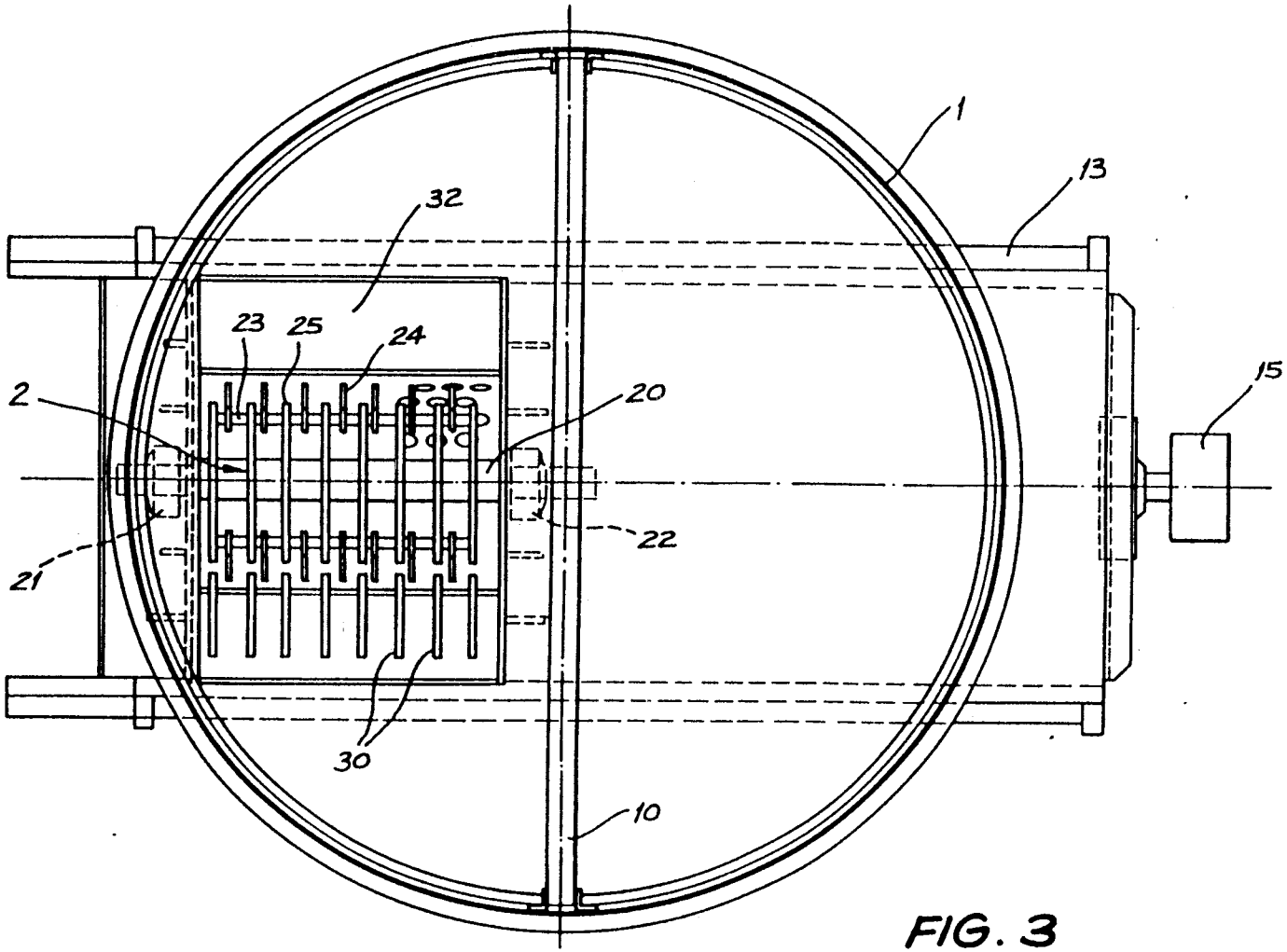
FIG. 3 is a plan view of the shredder.

As shown in FIG. 3, a set of fingers 30 and a deflector plate 32 having ribs on a underside thereof are provided in the base of the hopper.

Beneath the screen 3 is an outlet 40 leading to a transverse duct 41 in which is reciprocatingly located a pusher 42 of a compactor-discharger. The pusher is operated by a rod 44 reciprocated by an eccentric element 45 driven via gearbox 47 from drive cog 48. Typically the shredded material is compacted to a quarter of its original volume. On the outlet of the duct is a rubber flap 43 which is hinged at its upper end.

The shredder may be operated as follows. Material to be shredded, for example boxes of documents, is thrown into the top of the receiving hopper. The rotating hopper carries the material over the set of fingers 30 and onto the hammer-mill, where the paper is partially shredded and passed into the space between the hammer-mill and the perforated screen, where it is comminuted to a size small enough to pass through the perforations in the screen. Any material which passes out of the hammer-mill is deflected by plate 32 back onto the mill and is carried round past fingers 30 again. Any material remaining in the hopper continues to rotate until it comes over the hammer-mill once again and a further layer is "shaved-off".

Shredded sized material falls downwards through the screen into the outlet 40, where it remains until the pusher is retracted and it falls into the duct 41. Typically, the compactor-discharger reciprocates about 50 times per minute, compacts and discharges material out of the duct into a storage compartment (not shown), at the same time compacting it. When the shredder is mounted on a truck, the storage compartment typically contains 7 to 8 tonnes of shredded material.

We claim:

1. A shredder for shredding bulk waster paper cardboard, packaging material, microfilm, microfiche and other sheet material, comprising a receiving hopper for receiving material to be shredded which is rotatably mounted for rotation about a vertical axis, and having a stationary floor;

a rotary hammer-mill disposed below the hopper floor and protruding through a hammer-mill inlet into the hopper for shredding material contained in the hopper, the hammer-mill comprising a plurality of flails loosely mounted to the circumference of a body rotatably mounted about a generally horizontal axis;

a set of fingers interdigitated with the flails and mounted on the stationary hopper floor adjacent the inlet, the fingers extending toward the hammer-mill only on the side of the hammer-mill where rotation of the hammer-mill tends to force material downwardly out of the hopper, the balance of the inlet being completely unobstructed; a perforated screen partially enclosing the hammer-mill below the hopper floor and through which the shredded material passes when it has reached a chosen level of comminution;

reciprocating pusher means disposed in a horizontally extending duct arranged to receive the shredded material from the screen and to compact the shredded material, before discharging it from the duct past a non-return flap hingedly mounted at an outlet from the duct, said pusher means operating along a horizontal axis; and drive means arranged to drive the rotatable hopper, rotary hammer-mill and reciprocating pusher.

2. A shredder according to claim 1 wherein the receiving hopper further comprises paddle means mounted thereto and rotatable therewith for rotating the material to be shredded.

3. A shredder according to claim 1 wherein the hammer-mill is located eccentrically of the hopper and to one side of the vertical axis.

4. A shredder according to claim 1 wherein the hammer-mill rotatable body comprises a plurality of rods to which the flails are loosely attached in a parallel array around a central driven shaft.

5. A shredder according to claim 1 which further comprises a deflector plate mounted on the stationary floor and closely approaching the hammer-mill at a side opposite the set of fingers, to help prevent shredded material being deposited back into the hopper.

6. A shredder according to claim 1 wherein there is a clearance between the hammer-mill and the screen, which is greatest adjacent the hopper and least at a lower side of the screen.

7. A shredder according to claim 1 wherein the pusher means comprises a reciprocating plunger located in the duct, which withdraws to allow shredded material to fall into the space in the duct between the plunger and the non-return flap, and which extends to compact the material and discharge it past the flap.

8. A shredder according to claim 1 which is further provided with transportation means allowing the shredder to be transported for use on-site.

9. A shredder according to claim 1 wherein the reciprocating pusher means reciprocates a plurality of cycles per minute during shredding of material.

10. A shredder according to claim 9 wherein the reciprocating pusher means reciprocates about fifty cycles per minute during shredding of material.

11. A shredder for shredding bulk waster paper cardboard, packaging material, microfilm, microfiche and other sheet material, comprising a receiving hopper for receiving material to be shredded which is rotatably mounted for rotation about a vertical axis, and having a stationary floor;

a rotary hammer-mill disposed below the hopper floor and protruding through a hammer-mill inlet into the hopper for shredding material contained in the hopper, the hammer-mill comprising a plurality of flails loosely mounted to the circumference of a body rotatably mounted on a generally horizontal axis, the inlet of the hammer-mill being substantially completely unobstructed to facilitate receiving material form the hopper;

a set of fingers interdigitated with the flails and mounted on the stationary hopper floor, the fingers extending toward the hammer-mill only adjacent the side of the hammer-mill where rotation of the hammer-mill tends to force material downwardly out of the hopper; a perforated screen partially enclosing the hammer-mill below the hopper floor and through which the shredded material passes when it has reached a chosen level of comminution;

reciprocating pusher means disposed in a horizontally extending duct arranged to receive the shredded material from the screen and to compact the shredded material, before discharging it from the duct past a non-return flap hingedly mounted at an outlet from the duct, said pusher means reciprocating a plurality of cycles per minute along a horizontal axis at least during shredding of material; and drive means arranged to drive the rotatable hopper, rotary hammer-mill and reciprocating pusher.

12. A shredder according to claim 11 wherein the reciprocating pusher means reciprocates about fifty cycles per minute during a shredding operation.

* * * * *